United States Patent [19]

Walker

[11] Patent Number: 4,788,729

[45] Date of Patent: Dec. 6, 1988

[54] AIR MATTRESS WITH AUDIBLE PRESSURE RELIEF VALVE

[76] Inventor: Robert A. Walker, 108A Commerce Dr., Greer, S.C. 29641

[21] Appl. No.: 1,898

[22] Filed: Jan. 9, 1987

Related U.S. Application Data

[63] Continuation-in-part of Ser. No. 726,608, Apr. 14, 1985, Pat. No. 4,644,597, and a continuation-in-part of Ser. No. 492,954, May 9, 1983, abandoned.

[51] Int. Cl.[4] ..... A47C 27/08; E03B 7/07

[52] U.S. Cl. ..... 5/449; 5/455; 137/557

[58] Field of Search ..... 5/449, 453–455, 5/468; 137/557; 116/137 R

[56] References Cited

U.S. PATENT DOCUMENTS

| | | | |
|---|---|---|---|
| 585,834 | 7/1897 | Ruth . | |
| 614,968 | 11/1898 | Mohs . | |
| 960,920 | 6/1910 | Hill | 137/557 X |
| 1,230,071 | 6/1917 | Hawk | 137/557 X |
| 1,282,980 | 10/1918 | Takach . | |
| 1,382,831 | 6/1921 | Hilker . | |
| 1,453,721 | 1/1918 | Norwalk . | |
| 1,550,122 | 8/1925 | Swisher | 137/557 X |
| 1,629,901 | 11/1925 | Ahearn . | |
| 2,033,512 | 5/1930 | Carliss . | |
| 2,044,913 | 6/1936 | Miller . | |
| 2,059,226 | 11/1936 | Gates . | |
| 2,068,266 | 1/1937 | Engel . | |
| 2,069,105 | 1/1937 | Engle . | |
| 2,119,687 | 6/1938 | Rexroad . | |
| 2,232,530 | 2/1941 | Hosking . | |
| 2,255,932 | 9/1941 | Kraft et al. . | |
| 2,309,430 | 1/1943 | Albert . | |
| 2,325,685 | 8/1943 | Keefe . | |
| 2,415,150 | 2/1947 | Stein . | |
| 2,549,597 | 4/1951 | Harris et al. . | |
| 2,664,104 | 12/1953 | Anderson . | |
| 2,691,179 | 10/1954 | Kann . | |
| 2,741,780 | 4/1956 | Kimbrig . | |
| 2,758,608 | 8/1956 | Sutcliffe . | |
| 2,777,416 | 1/1957 | Messick | 116/137 X |
| 2,810,922 | 10/1957 | Davis . | |
| 2,842,783 | 7/1958 | Druck . | |
| 2,998,817 | 9/1961 | Armstrong . | |
| 3,068,494 | 12/1962 | Pinkwater . | |
| 3,128,480 | 4/1964 | Lineback . | |
| 3,148,391 | 9/1964 | Whitney . | |
| 3,303,518 | 2/1967 | Ingram . | |
| 3,310,818 | 3/1967 | Fischer . | |
| 3,351,081 | 11/1967 | Bogossian et al. . | |
| 3,477,071 | 11/1969 | Emerson . | |
| 3,505,695 | 4/1970 | Bishaf et al. . | |
| 3,536,071 | 10/1970 | Ferrando . | |
| 3,590,770 | 7/1971 | Wagner | 137/557 X |
| 3,590,851 | 7/1971 | Bogossian . | |
| 3,605,138 | 9/1971 | Tucker . | |
| 3,775,781 | 12/1973 | Bruno et al. . | |
| 3,784,994 | 1/1974 | Kery . | |
| 3,785,395 | 1/1974 | Andreasson . | |
| 3,790,975 | 2/1974 | Philipp et al. . | |
| 4,025,974 | 5/1977 | Lea et al. . | |
| 4,129,145 | 12/1978 | Wynn . | |
| 4,149,285 | 4/1979 | Stanton . | |
| 4,169,295 | 10/1979 | Darling . | |
| 4,175,297 | 11/1979 | Robbins et al. . | |
| 4,224,706 | 9/1980 | Young et al. . | |
| 4,225,989 | 10/1980 | Corbett et al. . | |
| 4,305,425 | 12/1981 | Mackal et al. . | |
| 4,371,999 | 2/1983 | Reid . | |
| 4,394,784 | 7/1983 | Swenson et al. . | |
| 4,644,597 | 2/1987 | Walker | 5/449 |

FOREIGN PATENT DOCUMENTS

| | | |
|---|---|---|
| 14351 | of 1911 | France . |
| 790720 | 2/1958 | United Kingdom . |
| 1338891 | 11/1973 | United Kingdom . |

*Primary Examiner*—Michael F. Trettel
*Attorney, Agent, or Firm*—Burd, Bartz & Gutenkauf

[57] ABSTRACT

An air mattress is equipped with a combined one-way air pressure relief valve and audio device operable to limit the air pressure in the air mattress to about 1 psi to prevent seam separation and blow-out. Air flowing out of the mattress through the combined air pressure relief valve and audio device produces an audible sound. The mattress has top and bottom walls joined to side and end walls with edge seams. The combined air pressure relief valve and audio device is located within the chamber of the air mattress so that external structures do not interfere with the functioning of the valve and audio device. In one arrangement, a boot secures the combined air pressure relief valve and audio device to the inside of an end wall. In a second arrangement, the combined air pressure relief valve and audio device is located within a seam.

23 Claims, 6 Drawing Sheets

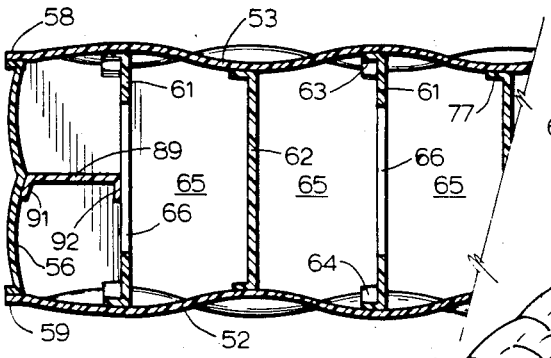
FIG. 12
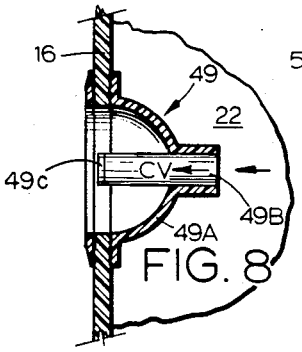
FIG. 8
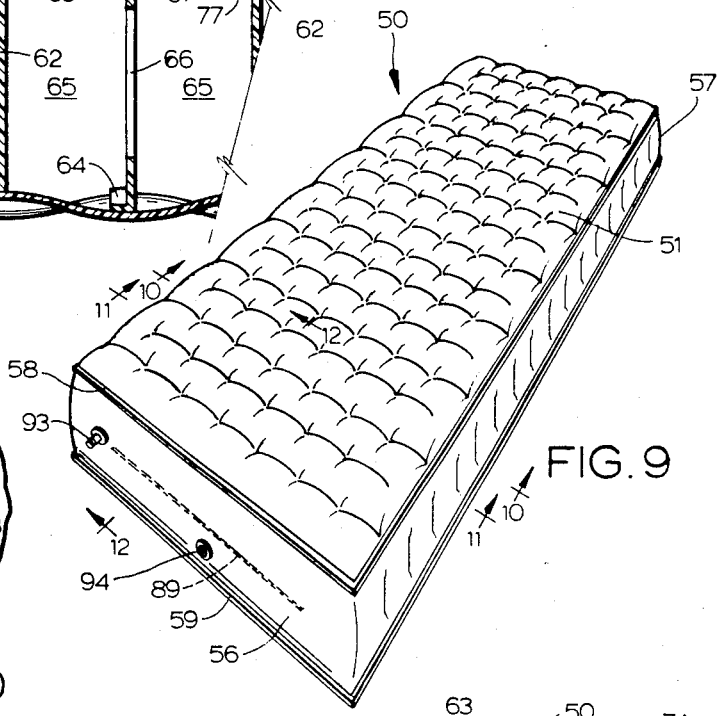
FIG. 9
FIG. 10
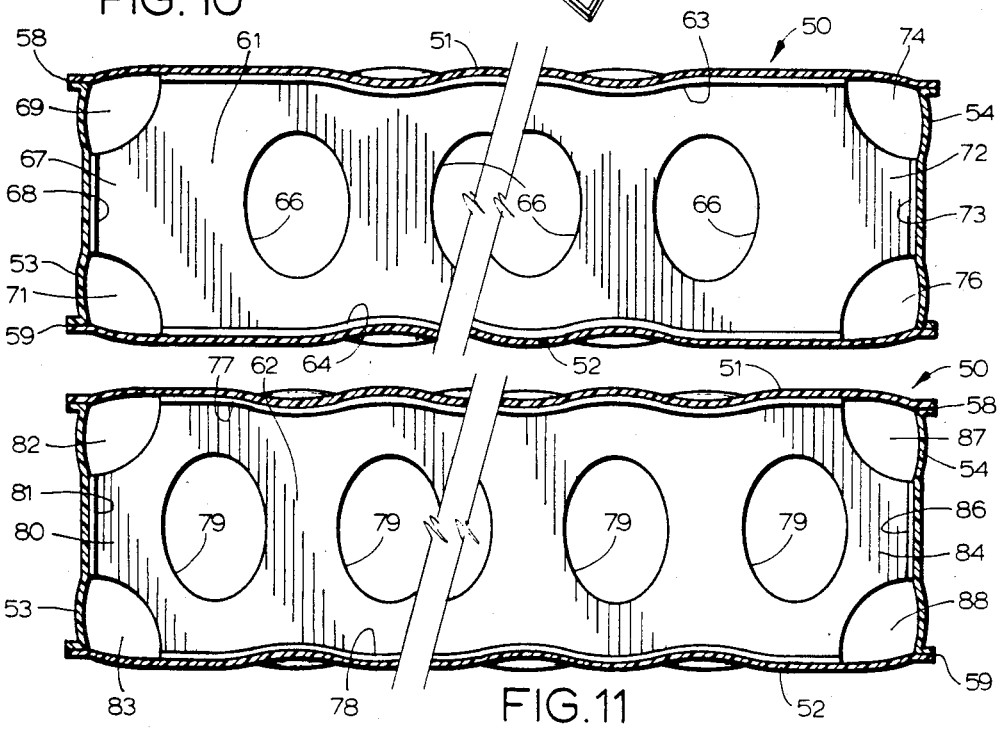
FIG. 11

AIR BLOWER
100
101
102
103
104
106
107
108
109
111
112
113
114
116
117
118
119
121
122
123
124
126
129
131
132
136
137
138
15
17
18

AIR MATTRESS WITH AUDIBLE PRESSURE RELIEF VALVE

CROSS REFERENCE TO RELATED APPLICATIONS

This application is a continuation-in-part of U.S. application Ser. No. 726,608 filed Apr. 14, 1985, now U.S. Pat. No. 4,644,597. Application Ser. No. 726,608 is a continuation-in-part of U.S. application Ser. No. 492,954 filed May 9, 1983, now abandoned.

FIELD OF INVENTION

This invention relates to inflatable supports, such as air mattresses, for use in air beds.

BACKGROUND OF INVENTION

Air mattresses are used with cots and beds to provide yieldable body supports. The air mattresses are generally flat bags having flexible air impervious sheet members secured together to form one or more longitudinal chambers for accommodating air under pressure. Air inlet tubes associated with air mattresses are used with hand-operated pumps, bag pumps, and other sources of air under pressure to inflate the mattresses. Plugs are used to close the tubes after the mattresses are inflated with air. Conventional air mattresses do not have pressure relief valves so that they can be easily over-inflated, causing rupture of the mattress material or the separation of the seams. An over-inflated air mattress is relatively hard and can become misshaped and wobbly. Air mattresses tend to wear out quickly when the air chambers are constantly over-stressed or over-inflated.

SUMMARY OF INVENTION

The invention is a fluid accommodating apparatus or mattress providing a support for a body, such as a human body. The mattress preferably accommodates a fluid, such as air under pressure of 1 psi or less. A combined pressure relief valve and audio device is operable to insure that the air pressure is maintained below a predetermined value so as not to over-inflate the mattress and provide a recognizable signal when air pressure within the mattress is above a desired pressure. The audio device is a whistle mounted on the end of a pressure release valve body providing audibly signals of release of air through the valve passage. The audio device indicates when the mattress is being over-inflated or over-stressed and that measures should be taken to reduce these occurrences. The audio device also helps to identify mattress leaks and the source of the leaks. The mattress is adapted to be coupled to a pump means operable to provide a supply of air under pressure to the mattress and allow air to exhaust from the mattress. The mattress has top and bottom walls that are connected together with side walls and end walls to form an enclosed air impervious chamber. The chamber is divided into a plurality of connected transverse gas accommodating passages with a plurality of beams or webs. Each web is joined to the top and bottom walls and the side walls and functions to limit outward expansion of the walls. An air inlet means secured to one of the walls is useable to facilitate the supply of fluid under pressure into the passages.

According to the invention, there is provided an air mattress having flexible top and bottom walls located in spaced relation relative to each other. First and second side walls and end walls are joined to the outer edges of the top and bottom walls to form an enclosed chamber for accommodating air under pressure. An air inlet means associated with one of the walls is used to carry air from a source of air under pressure into the air mattress.

A plurality of transverse sheet beams or webs are secured to the top and bottom walls and side walls to maintain the air mattress in a box-like shape. Horizontal ribs associated with the front and rear walls and front and rear transverse webs are used to reinforce the front and rear walls and maintain their upright positions when the mattress is inflated with air. The opposite ends of the transverse webs have openings to allow air to flow into and out of the transverse air chambers. The walls and webs are Nylon fabric and vinyl plastic sheet members sealed together. These sheet members are air impervious and form seals that do not tear or rip apart in use. A combined one-way air pressure relief valve and audio device mounted on a wall prevents and signals over-inflation of the air mattress. The combined pressure relief valve and audio device in one embodiment of the invention has a flexible boot supporting a valve body within the chamber. The valve body supports a movable spring-biased valving member operable to allow air to evacuate from within the air mattresses when the pressure exceeds a selected evel, such as 1 psi. A whistle is fitted into the end of the valve body. The whistle is activated by the flow of air through the valve body. In one form of the air mattress, the transverse webs have holes to allow limited expansion of separate portions of the top and bottom walls of the air mattress. This results in a mattress surface having a tuffed convex shape.

The invention includes an audio one-way valve providing recognizable audio signal when the valve is open and fluid is flowing through the open valve. The fluid can be a gas or 1 These and other advantages of the combined air pressure release valve and audio device are embodied in the air mattress disclosed in the following description.

IN THE DRAWING

FIG. 8 is an enlarged sectional view taken along the line 8—8 of FIG. 5;

FIG. 9 is a perspective view of a modification of the air mattress of the invention;

FIG. 10 is an enlarged foreshortened sectional view taken along the line 10—10 of FIG. 9;

FIG. 11 is an enlarged foreshortened sectional view taken along the line 11—11 of FIG. 9;

FIG. 12 is an enlarged sectional view taken along the line 12—12 of FIG. 9.

DESCRIPTION OF PREFERRED EMBODIMENTS

Figures 1, 2, 3, 4, 5, 6, 7:
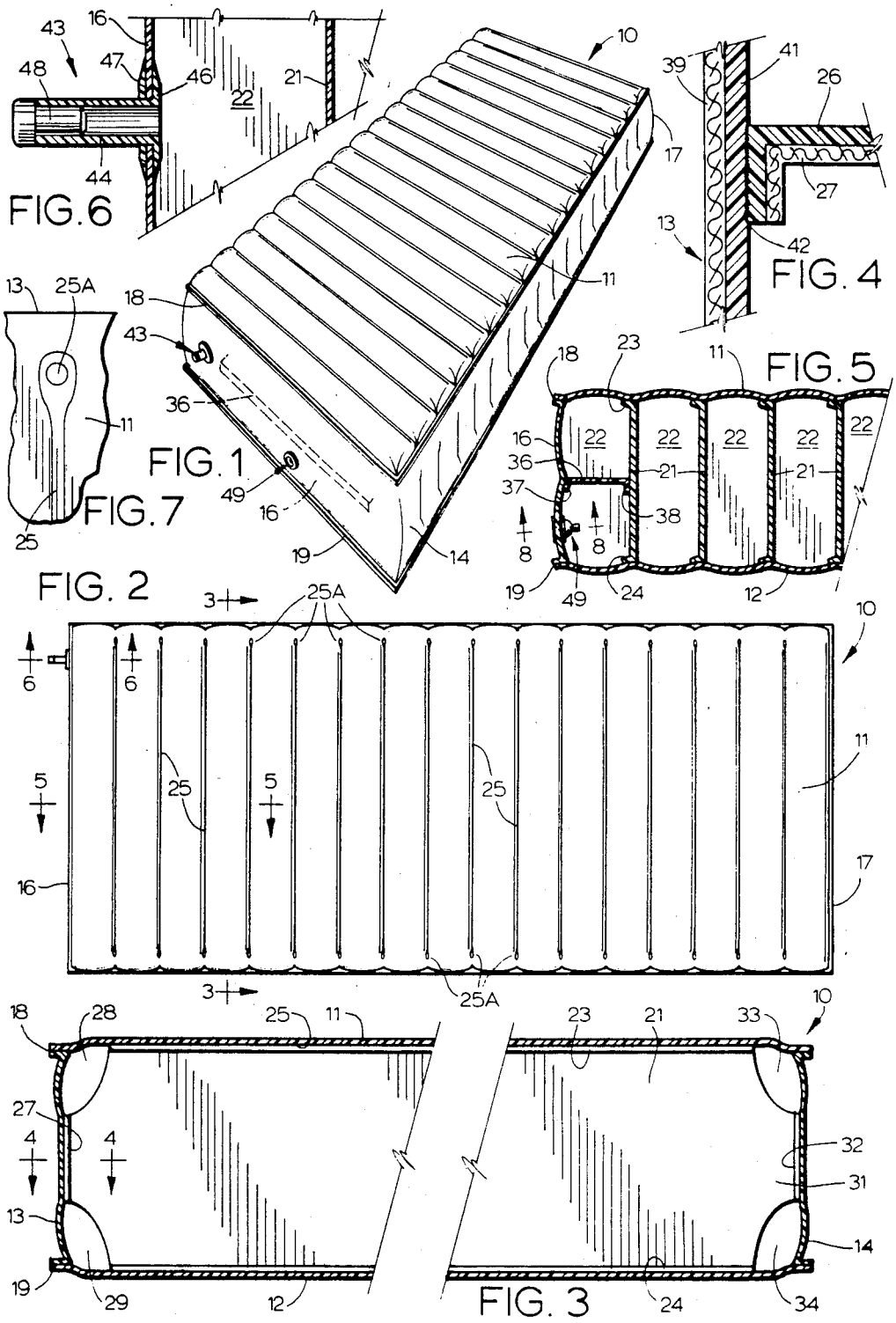
FIG. 1 is a perspective view of an air mattress having a combined air pressure relief valve and audio device of the invention.
FIG. 2 is an enlarged top plan view of the mattress of FIG. 1.
FIG. 3 is an enlarged foreshortened sectional view taken along the line 3—3 of FIG. 2.
FIG. 4 is an enlarged sectional view taken along the line 5—5 of FIG. 2.
FIG. 5 is an enlarged sectional view taken along the line 5—5 of FIG. 2.
FIG. 6 is an enlarged sectional view taken along the line 6—6 of FIG. 2.
FIG. 7 is an enlarged plan view of a portion of the top of the apparatus.

Referring to FIGS. 1 and 2, there is shown a fluid accommodating air mattress having a combined air pressure relief valve and audio device of the invention indicated generally at 10 useable to yieldably support an object. Apparatus 10 accommodates a compressible fluid, such as air, to yieldably support an object in a horizontal position. The apparatus is preferably an air mattress, or bladder used in an air bed to yieldably support on or more prone persons.

Air mattress 10 has a generally rectangular top wall 11 located over a rectangular bottom wall 12. Side walls 13 and 14 and end walls 16 and 17 are secured to the outer peripheral edges of top and bottom walls 11 and 12. Upper and lower continuous peripheral seals 18 and 19 join the adjacent edges of walls 11-14 and 16 and 17. Seals 18 and 19 are ultrasonic fluid impervious connections that permanently join peripheral adjacent portions of walls 11-14 and 16 and 17 together. Seals 18 and 19 are lap seams forming the outer peripheral edges of the air mattress.

As shown in FIGS. 3 and 5, a plurality of laterally spaced transverse internal webs or beam supports 21 linearly extend between side walls 13 and 14. Each support 21 has a body or web section and opposite end portions. The upper edges of the web sections of supports 21 have lips 23 that are secured to the inside surface of upper wall 11. The lower portions of the web sections have lower lips 24 that are secured to the inside surface of bottom wall 12. Seals 25 are utilized to secure lips 23 and 24 to the upper and lower walls 12. Seals 25 extend transversely across top and bottom walls 11 and 12 and terminate in enlarged ends 25A.

As shown in FIG. 7, each end 25A has an enlarged tear drop shape spaced inwardly from adjacent side walls 13 and 14 to provide air passages 28 and 33. The enlarged ends 25A strengthen the ends of each seal. Webs 21 are flexible, non-elastic sheet members that prevent the upper and lower walls 11 and 12 from ballooning or bulging outwardly. Webs 21 divide the interior of apparatus 10 into a plurality of transverse fluid accommodating passages or chambers 22. Chambers 22 extend transversely across apparatus 10 and are located side-by-side between the end walls 16 and 17.

As shown in FIGS. 1 and 2, transverse webs 21 are equally spaced from each other along the longitudinal dimension or length of the air mattress. Adjacent webs 21 provide separate transverse gas passages or chambers 22. Adjacent webs 21 are preferably laterally spaced about 10 cm. Other lateral dimensions between adjacent webs 21 may be used. Webs 21 vertically reinforce top and bottom walls 11 and 12 and restrict outward expansion or bulging of these walls. Webs 21 also laterally reinforce the opposite side walls 13 and 14 and restrict outward expansion of these walls. All of webs 21 cooperate with the top, bottom, and side walls 11, 12, 13, 14, 16 and 17 to retain the box shape of air mattress 10.

Referring to FIG. 3, internal support 21 has a first end portion 26 terminating in a right angle turned ear 27. The ear 27 is secured by an ultrasonic seal to the mid-portion of side wall 13. Openings 28 and 29 are located adjacent upper and lower sides of end portion 26 to permit gas to flow into the end of an adjacent chamber 22. The opposite end of support 21 has a second end portion 31 terminating in a right angle turned ear 32. Ear 32 is secured to the mid-portion of end wall 14. Openings 33 and 34 located on opposite sides of second end portion 31 allow the gas to flow into the end of an adjacent air chamber 22. The first and second end portions 26 and 31 retain side walls 13 and 14 in generally upright positions when the pressure of the gas in the chambers 22 is increased. Each of supports 21 has end portions that are secured to middle portions of the side walls 13 and 14.

As shown in FIG. 5, a generally horizontal end support or rib 36 is provided with lips 37 and 38. Lip 37 is secured to the mid-portion of end wall 16. Lip 38 is secured to the adjacent internal support 21. The horizontal support retains end wall 16 in a generally upright position, as shown in FIG. 1. The opposite end of air mattress 10 has a generally horizontal support (not shown) that is identical to support 36 to retain end wall 17 in a generally vertical position.

As shown in FIG. 4, side wall 13 is a fabric plastic sheet member comprising an outer fabric layer 39 and an inner plastic layer 41. The layers 39 and 41 are integrally joined together to form an air impervious wall. Seal 42 joins the ear 27 to the mid-portion of side wall 13. The side wall can be a Nylon vinyl, polyester vinyl, or Rayon vinyl. These materials are flexible, strong, and air impervious. They also do not deteriorate over time and re water-resistant.

Referring to FIGS. 1 and 6, a plug tube assembly indicated generally at 43 is secured to one end of the end wall 16. Assembly 43 is used as an inlet passageway to allow gas to flow into chambers 22. The gas can be derived from a pump, such as an air pump or blower.

Assembly 43 comprises a short tube 44 having a head 46. A washer 47 surrounding tube 44 is located adjacent the outside of wall 16 and is secured thereto with head 46 to join assembly 43 to end wall 16. The outer end of tube 44 is closed with a removable plug 48. The tube 44 can be connected with a suitable hose to an air pump, air blower, or a like source of air under pressure. Suitable valves (not shown) can be used to regulate the supply of air under pressure that is carried via tube 44 into chambers 22 of air mattress 10 and exhaust air therefrom.

An air control system for an air bed is disclosed in co-pending U.S. application Ser. No. 455,664. This air control system has a pump and hand-operated switches for regulating valves and the pump to supply air to air mattresses. Other types of air control systems can be used to supply air to apparatus 10.

Figure 20:
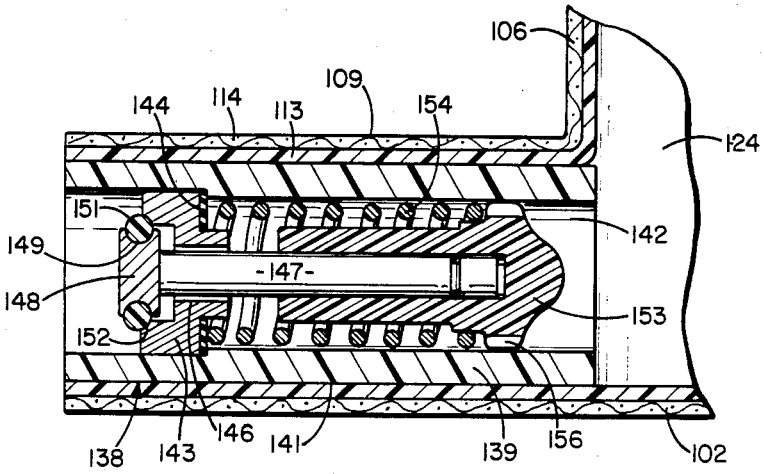
FIG. 20 is an enlarged sectional view taken along the line 20—20 of FIG. 19.
Figure 21:
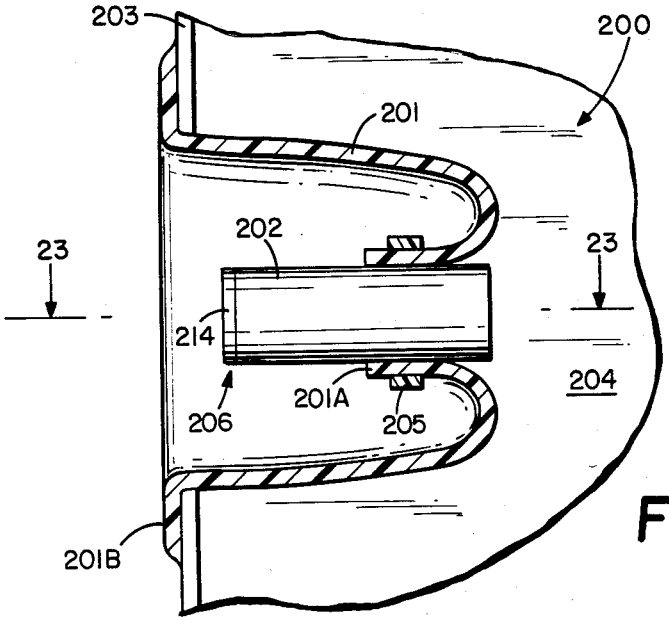
FIG. 21 is a sectional view of the air pressure relief valve and audio device similar to FIG. 8 incorporated into an air mattress.
Figure 22:
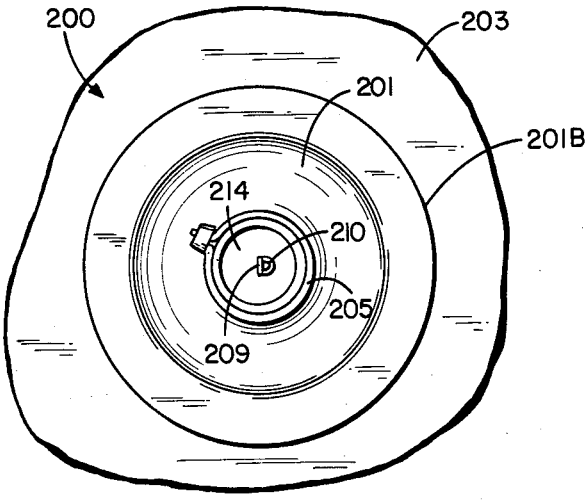
FIG. 22 is an external elevational view of the combined air pressure relief valve and audio device mounted by an external wall and air mattress of FIG. 21.
Figure 24:
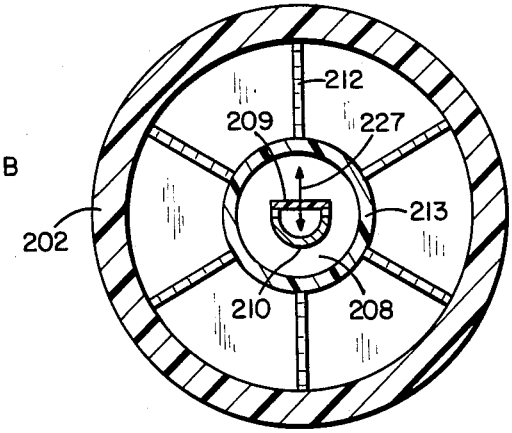
FIG. 24 is an enlarged sectional view taken along the line 24—24 of FIG. 23.

As shown in FIGS. 1, 5, and 8, a combined one-way air pressure relief valve and audio device 49 mounted on end wall 16 prevents and signals over-inflation of air mattress 10, which can cause wall rupture seam separation or blow-out. Referring to FIG. 8, valve and audio device 49 has a flexible boot 49A supporting a valve body 49B. Boot 49A and valve body 49B are attached to the inside of end wall 16, thereby locating the valve and audio device within chamber 22. Valve body 49B is a tubular member accommodating a movable spring biased valving member, as shown in FIG. 20, operable to open the valving member, as shown in FIG. 20, operable to open the air passage of the valve body and allow air to flow from chamber 22 to the atmosphere when air pressure in chamber 22 reaches a predetermined value. For example, when the air in chamber 22 reaches a pressure of 1 psi or greater, the valving member will move to the open position thereby venting air from chamber 22 to the atmosphere and reducing the air pressure within the mattress. Valve body 49B also accommodates a whistle 49C operable to produce an audible sound when air is vented from chamber 22 through the passage of the valve body. When the air pressure drops below the maximum value, such as 1 psi, the valving member will automatically close terminating the audio signal. This prevents over-inflation of air mattess 10 that leads to separation of the seams and bursting of the walls thereof. The pressure relief and sound characteristics of valve and audio device 49 can be selected to provide for a desired maximum pressure of air in chamber 22 of air mattress 10. For example, valve and audio device 49 is operable to limit the pressure of air within air mattress 10 to about 1 psi.

Referring to FIGS. 9 to 12, there is shown a modification of the air mattress of the invention indicated generally at 50. Air mattress 50 is commonly termed an air bag or air bladder used to yieldably support one or more persons in an air bed.

Air mattress 50 has a flexible generally rectangular top wall 51 located over a bottom wall 52. Opposite side walls 53 and 54 and end walls 56 and 57 join the peripheral edges of the top and bottom walls 51 and 52. A continuous upper peripheral seal 58 joins the outer peripheral edge of upper wall 51 to the top edges of the side walls and end walls 53–57. The outer peripheral edge of bottom wall 52 is secured with a continuous lower peripheral seal 59 to the lower edges of the side wall and end walls 53 to 57. The seals 58 and 59 are continuous air impervious seals so as to maintain the air under pressure within air mattress 50.

The inside of air mattress 50 has a plurality of pairs of transverse internal supports 61 and 62 providing the top and bottom walls 51 and 52 and side walls 53 and 54 with support to minimize the outward expansion or bulging of these walls as a result of the pressure of the gas within air mattress 50. Supports 61 and 62 divide the inside of apparatus 50 into a plurality of transverse gas accommodating chambers 65. Chambers 65 extend between side walls 53 and 54. Air mattress 50 has a series of side-by-side passages that extend from the front end wall 56 to the rear end wall 57.

As shown in FIG. 10, internal support 61 has a generally flat beam having an upper lip 63 secured by a seal or the like to the inside of top wall 51. A lower lip 64 is secured by a seal to the inside of the lower wall 52. Support 61 has a plurality of holes 66. The holes 66 allow support 61 to expand in a generally vertical or upright direction so that the air pressure within chamber 65 causes the top and bottom walls to expand outwardly. This provides the top and bottom walls 51 and 52 with a plurality of outwardly convex curved portions or a tuffed shape. Walls 51 and 52 have a tuffed shape when gas under pressure is stored in the apparatus. Supports 61 and 62 comprise pairs of web-like members that are evenly spaced along the length of the apparatus. As shown in FIG. 9, eight pairs of supports 61 and 62 are incorporated in apparatus 50. Support 61 has an end portion 67 terminating in an ear 68. The ear 68 is secured to the mid-section of side wall 53. Openings 69 and 71 are located above and below end portion 67 and allow gas to flow into adjacent chamber 65. Holes 66 also allow air to flow between adjacent chambers. Support 61 as a second end portion 72 terminating in a lip 73. Lip 73 is secured to the mid-section of side wall 54 to prevent the side wall from bulging outwardly when subjected to air under pressure. The openings 74 and 76 located above and below end portion 72 allow gas to flow into the adjacent chamber 65. As shown in FIG. 11, the internal support 62 has a web member or beam extending between the top and bottom walls 51 and 52. Support 62 is laterally spaced from support 61 to form a transverse gas chamber. A lip 77 secures the top of support 62 to the inside of top wall 51. In a similar manner, a lip 78 secures the bottom of support 62 to the inside of bottom wall 52. Support 62 has a plurality of holes 79. Holes 79 are laterally offset from holes 66 in support 61. Portions of the top and bottom walls 51 and 52 adjacent the holes 79 bulge outwardly providing the top and bottom walls with shallow convex-shaped portions that are laterally offset from convex-shaped portions formed by holes 66 and support 61. Support 62 has a first end portion 80 terminating in an ear 81. The ear 81 is secured to the mid-section of side wall 53. Openings 82 and 83 are located above and below end portion 80 and allow gas to flow into adjacent chamber 65. Holes 79 also allow air to flow between adjacent chambers. Support 62 has a second end portion 84 terminating in a lip 86. Lip 86 is secured to the mid-section of side wall 54 to prevent the side wall from bulging outwardly when subjected to air under pressure. The openings 87 and 88 above and below end portion 84 allow gas to flow into the adjacent chamber 65.

As shown in FIG. 12, a generally horizontal end support or rib 89 is provided with lips 91 and 92. Lip 91 is secured to the mid-portion of end wall 56. Lip 92 is secured to the adjacent internal support 61. The horizontal support 89 retains end wall 56 in a generally upright position, as shown in FIG. 9. The opposite end of air mattress 50 has a generally horizontal support (not shown) that is identical to support 89 to retain end wall 57 in a generally vertical position.

Referring to FIG. 9, a plug tube assembly 93 is secured to one end of the end wall 56. Assembly 93 is used as an inlet passageway to allow gas to flow into chambers 65. The gas can be supplied by a pump, such as an air pump or air blower.

Figure 26:
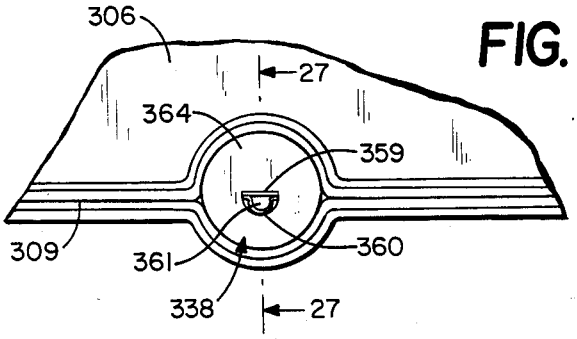
FIG. 26 is an enlarged external elevational view of the combined air pressure relief valve and audio device of the air mattress of FIG. 25.
Figure 27:
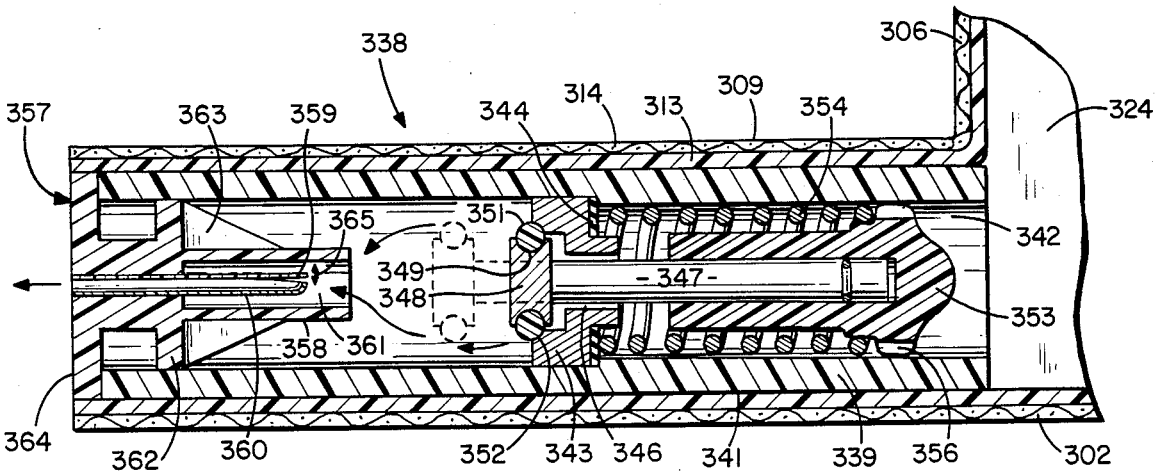
FIG. 27 is an enlarged sectional view taken along the line 27—27 of FIG. 26.

A combined one-way air pressure relief valve and audio device 94 is mounted on end wall 56 adjacent the seam 59. Details of valve and audio device are shown in FIGS. 26 and 27. The valve and audio device 94 functions to relieve and regulate the maximum air pressure in the mattress. When the pressure exceeds a predetermined limit, such as 1 psi, valve and audio device 94 will open to evacuate air from the air mattress. Air evacuated through the valve and audio device 94 produces an audible sound. This prevents over-inflation of the apparatus, signals when air is flowing from the air mattress, and eliminates the seam separation and bursting of the walls thereof.

Examples of air mataresses are as follows:

The air mattresses are made in different sizes, i.e., twin, full, queen, and king size. These mattresses have a width from 39 inches (99 cm) to 84 inches (213 cm). The mattress has a thickness of 4 inches (10 cm) apart along the length thereof. The walls and webs are made of Nylon vinyl sheet material. An ultrasonic sealing and vulcanization processes are used to make the airtight seams. The air mattress has a high degree of stability, as the air moves transversely in passages 22 when a body rests on top wall 11. Only a controlled restricted amount of air moves longitudinally. The air mattress has a rectangular box shape with generally flat sides and ends. The air mattress fits in the dish support of the bed. A combined air pressure relief valve and audio device is secured to an end wall of the air mattress. The valve and audio device is located within the chamber of the air mattress so that outside objects, such as mattress covers, bed structures, and the like do not interfere with the operation of the valve and audio device. The valve and audio device has a spring biased valving member operable to open when the pressure of the air in the air mattress exceeds 1 psi. The valving member automatically closes when the air pressure in chamber falls below 1 psi. The value and audio device 94 also has a whistle that is activated by air vented through the valve body from the mattress. The whistle audibly indicates that the mattress is being over-stressed or over-inflated.

Figures 13, 14, 15, 16, 18:
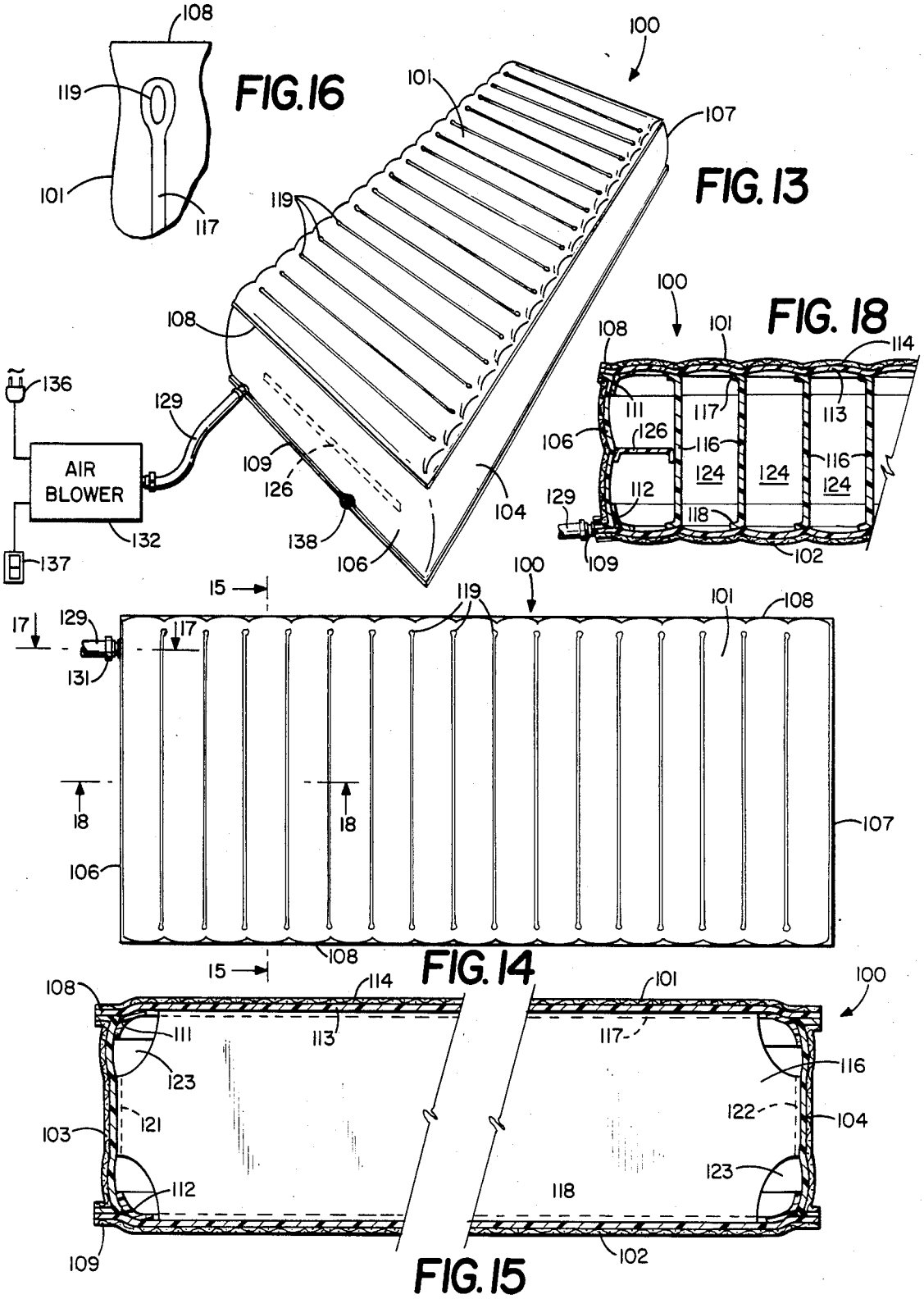
FIG. 13 is a perspective view of another modification of the air mattress having an air pressure relief valve of the invention connected to an air blower.
FIG. 14 is an enlarged top plan view of the air mattress of FIG. 13.
FIG. 15 is an enlarged foreshortened sectional view taken along the line 15—15 of FIG. 14.
FIG. 16 is an enlarged top plan view of a portion of the air mattress of FIG. 14.
FIG. 18 is a sectional view taken along the line 18—18 of FIG. 14.

Referring to FIGS. 13 and 14, there is shown another modification of the air mattress with an air pressure relief valve of the invention indicated generally at 100. Air mattress 100 accommodates a compressible fluid, such as air, to yieldably support one or more persons in a horizontal or prone position. Preferably, apparatus 100 is an air mattress, used in an air bed to yieldably support one or more prone persons. Apparatus 100 has an air pressure relief valve 138 operable to limit the internal air pressure to about 1 psi to prevent mattress blow-out.

Air mattress 100 has a generally rectangular top wall 101 located over an identical bottom wall 102. Side walls 103 and 104 and end walls 106 and 107 extend between the top and bottom walls 101 and 102 to complete the outer structure of the air mattress. The top wall 101 and side walls 103, 104 and end walls 106, 107 have a continuous upper peripheral edge 108 that are joined together to form a gas impervious seal. In a similar manner, bottom wall 102 is joined to the side walls 103, 104 and end walls 106, 107 with a lower outwardly directed peripheral edge 109. As shown in FIGS. 15 and 18, a continuous strip 111 located in the inside of air mattress 100 is positioned over the seam of the upper peripheral edge 108. A strip 112 located inside air mattress 100 is located over the seam of the lower peripheral edge 109. The strips 111 and 112 are vulcanized to their adjacent walls to reinforce the seams of edges 108 and 109.

Figure 17:
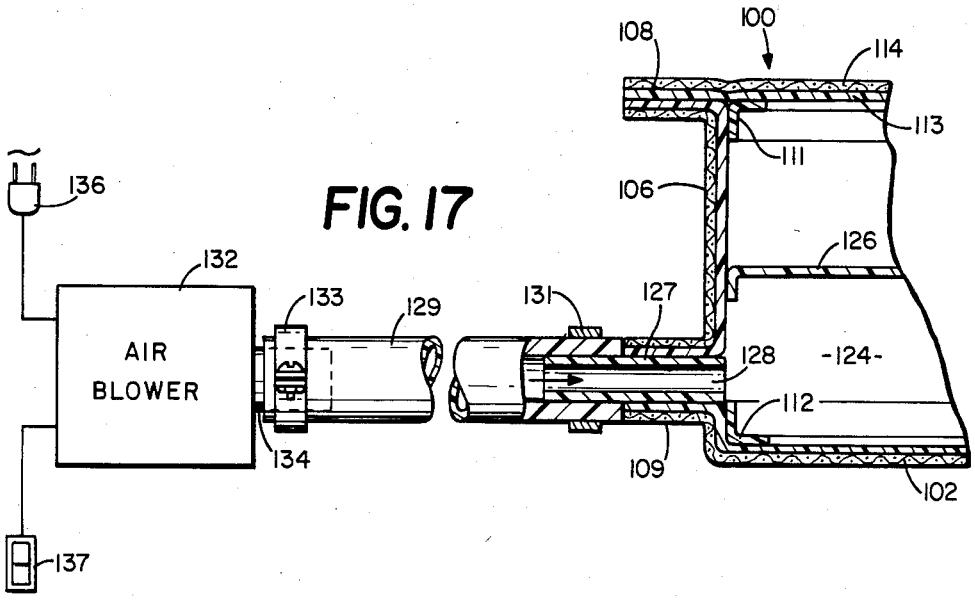
FIG. 17 is an enlarged foreshortened sectional view taken along the line 17—17 of FIG. 14.

As shown in FIGS. 15, 17, and 18, the walls 101, 102, 103, 104, 106, and 107 are fabric and plastic sheets comprising an inner plastic layer 113 and an outer fabric layer 114. Layers 113 and 114 are integrally joined together to form air impervious walls. Plastic layer 113 may be a Nylon vinyl, polyester vinyl or Rayon vinyl. These materials are strong, flexible, air impervious, water resistant, and do not deteriorate over time. Fabric layer 114 is a soft fabric, such as cotton or a synthetic fabric, bonded to the outside surface of layer 113.

The rectangular shape of air mattress 100 is maintained when inflated with air under pressure by a plurality of laterally spaced transverse internal ribs or beams 116. Beams 116 linearly extend between side walls 103 and 104. The upper and lower portions of beams 116 have lips 117 and 118 that are secured to top and bottom walls 101 and 102, respectively. As shown in FIG. 16, the seams formed by the lip 117 terminate in tear drop end portions 119 inwardly from outer edge 108 of top wall 101. End portions 119 strengthen the ends of the seals joining beam 116 to top and bottom walls 101 and 102. Beam 116 has central ears 121 and 122 at the opposite ends thereof secured to the side walls 103 and 104, respectively. Beams 116 are flexible, non-elastic sheet members that prevent the upper and lower walls 101 and 102 from ballooning or bulging outwardly. Beams 116 also divide the interior chamber of air mattress 100 into a plurality of transverse air accommodating passages or chambers 124. Chambers 124 extend transversely across the air mattress and are located side-by-side along the entire length of the air mattress. Openings 123 in each of the corners of transverse beams 116 provide passages for the flow of air into and out of adjacent chambers 124. Holes can be placed in beams 116, such as holes 66 and 79 shown in FIGS. 10 and 11 to provide the top and bottom of the mattress with a rounded or tuffed convex curved structure. The adjacent beams 116 are preferably laterally spaced from each other about 10 cm. Other lateral dimensions between beams 116 may be used. Beams 116 form vertical and horizontal reinforcement for the top and bottom walls and side walls of the air mattress so that the air mattress retains a generally box shpe as shown in FIGS. 13 and 14 when inflated with air.

Referring to FIG. 18, a generally horizontal rib 126 located in the center of the end chamber 124 is secured to the end wall 106 and adjacent beam 116. Rib 126 reinforces and maintains the generally vertical shape of end wall 106 when the air mattress is inflated. A similar horizontal rib (not shown) is located in the opposite end of the air mattress to reinforce and maintain the vertical shape of end wall 107.

As shown in FIGS. 13 and 17, air mattress 100 is connected to an air blower 132 operable to supply the air mattress with air under pressure and allow air to exhaust from the air mattress. A tube 127 is located in the seam of the lower peripheral edge 109. Tube 127 is a plastic tubular member that is vulcanized to bottom wall 102 and end wall 106 forming the lower peripheral edge 109. Tube 127 has a passage 128 open to chamber 124 and a hose 129. Hose 129 fits over the outer end of tube 127 and is secured thereto with a ring clamp 131. The opposite end of hose 129 is located about an air outlet tube 134 of air blower 132. A ring clamp 133 holds hose 129 on air outlet tube 134. The air blower 132 has an electric motor (not shown) coupled to a source of electric power with a plug 136. A three-position switch 137 is used to control the operation of the electric motor. The motor drives a fan or impeller that moves air under pressure to hose 129, tube 127 and into air mattress chamber 124. A person lying on the air mattress 100 can utilize switch 137 to operate the air blower to increase the pressure of the air in the air mattress or cause the air in the mattress to be evacuated to the atmosphere. An air control system for an air bed is disclosed in co-pening U.S. application Ser. No. 455,644. This air control system including its pump and valves can be used to supply air under pressure to the air mattress 100. The air control system of application Ser. No. 455,644 is incorporated herein by reference.

Figure 19:
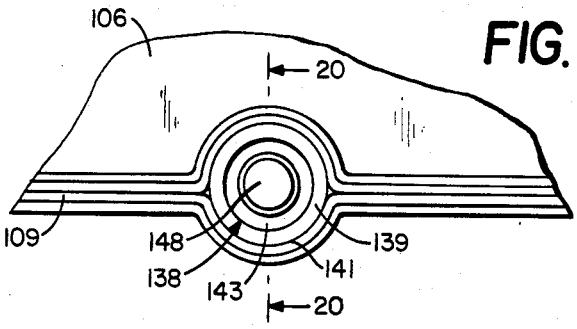
FIG. 19 is an enlarged portion of the outside end of the air mattress and pressure relief valve.

As shown in FIGS. 13, 19, and 20, a one-way pressure relief valve, indicated generally at 138, is incorporated in the lower peripheral edge 109. The entire valve 138 is located within the confinement of edge 109. The operation of the pressure relief valve is not affected by outside structures, such as mattress covers, bed frames, and the like. Valve 138 operates under all positions of the mattress to maintain a predetermined maximum air pressure in air mattress chamber 124. Preferably, the maximum of air pressure is about 1 psi. An air pressure exceeding 1 psi will open the pressure relief valve 138 allowing air to exhaust to the atmosphere thereby relieving the pressure of the air within chamber 24. Air mattress 100 can be used with the pressures below 1 psi. The air blower 132 is used to supply the air under pressure to the mattress. Hand control 137 is used to control the exhaust of air from the mattress and thereby control the pressure of the air within the mattress.

Pressure relief valve 138 has a cylindrical plastic body 139 having a cylindrical outer surface 141. The outer surface 141 is secured by vulcanization to plastic layers 113 of the bottom wall 102 and end wall 106 forming the lower peripheral edge 109. Body 139 is permanently secured to plastic layers 113. Body 139 has a linear passage 142 accommodating a plug 143. Plug 143 fits into the outer end of passage 142 with a friction fit and holds an annular seal 144 in engagement with the inside of body 139. Plug 143 has a central hole 146 accommodating a linear rod 147. Rod 147 as as its outer end a cylindrical head 148 having an outer peripheral groove 149. An O-ring 151 fits into groove 149 and engages an annular inclined seat 152 surrounding the outer end of hole 146. Seat 152 is in an outer annular portion of plug 143. Rod 147 extends through hole 146 toward mattress chamber 124. A cup member 153 is snapped onto the inner end of rod 147. Cup member 153 has a plurality of circumferentially spaced ears 156 which allow air to flow past cup member 153 through passage 142. A coil spring 154 is interposed between ears 156 and seal 144 to continuously bias the O-ring 151 into sealing engagement with annular seat 152.

When the pressure of the air in the mattress chamber 124 exceeds the biasing force of spring 154, head 148 will move outwardly thereby moving O-ring 151 away from seat 152 opening passage 146. The air flows past head 148 to the atmosphere relieving the pressure of the air in the chamber 124. Valve 138 automatically prevents over inflation of the air mattress and the separation of the seams and the flow-out or bursting of the walls 102, 103, 104, 106 and 107. Head 148 is always located within passage 142 of tube 139 so that outside structures, such as mattress covers, bed frames, and the like do not interfere with the operation of the valve. The pressure relief characteristic of valve 138 is determined by selecting the biasing force of spring 154 to provide a desired maximum pressure of the air in chamber 124. For example, when the biasing force of spring 154 is equal to 1 psi, the valve 138 will open when the pressure of the air in chamber 124 exceeds 1 psi.

Referring to FIGS. 21 to 24, there is shown the combined one-way air pressure relief valve and audio device of the invention indicated generally at 200. Valve and audio device 200 has a flexible boot 201 having a tubular inner end 201A supporting a valve body 202. A ring clamp 205 located about end 201A holds boot 201 on body 202 and seals end 201A on body 202. Boot 201 has an outer annular flange 201B secured to air mattress end wall 203, thereby locating the valve and audio device 200 within mattress chamber 204. Body 202 has a linear passage 207 accommodating a whistle indicated generally at 206. The whistle has a central tubular portion 213 with passage 208 accommodating a reed 209 and an U-shaped vibrator base 210. Whistle 206 has an inner flange 211 that engages the inside surface of body 202 in a close fitting relation. Triangular supports 212 are secured to the flange 211 and tube 213 to hold the flange in its close fit relation with body 202. A circular head 214 attached to the outer end of tube 213 has a diameter greater than the diameter of body 202 to prevent the inward movement of whistle 206 in passage 207. An adhesive can be used to secure head 214 to the end of body 202.

Figure 23:
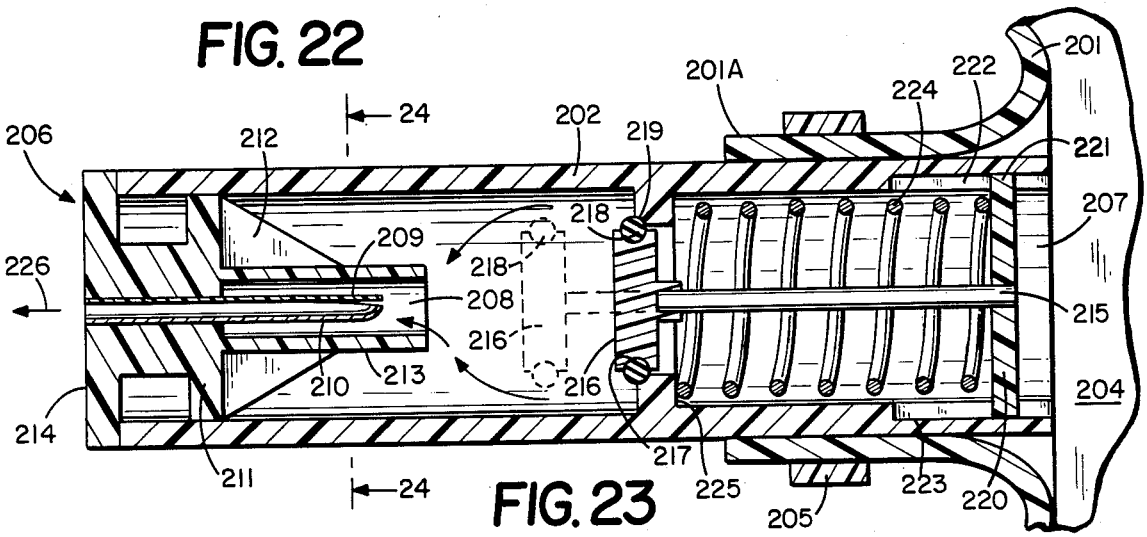
FIG. 23 is an enlarged sectional view taken along the line 23—23 of FIG. 21.

The one-way pressure relief valve is positioned inwardly of whistle 206. The valve has a linear rod 215 movable within the inner end of passage 207, as shown in FIG. 23. Rod 215 is connected to an outer cylindrical head 216 having an outer peripheral groove 217. An O-ring 218 fits into groove 217 and engages an annular inclined seat 219 extending inwardly from the inner surface of body 202. A spider head 220 is snapped onto the inner end of rod 215. Head 220 has a plurality of circumferentially spaced arms 221 which allow air to flow past the spider head 220 through passage 207. Arms 221 are movable within slots 222 provided in the inner surface of body 202 inward from seat 219. Edges 223 at the outer end of slots 222 prevent further outward movement of arms 221 and thereby limit the open position of head 216. A coil spring 224 is interposed between arms 221 and an inwardly directed rib or stop member 225 to continuously bias the O-ring 218 into sealing engagement with annular seat 219.

When the pressure of the air in the mattress chamber 204 exceeds the biasing force of spring 224, such as 1 psi, head 214 will move outwardly causing O-ring 218 to move away from seat 219 opening passage 207. The air flows past head 214, as shown by arrows, and through whistle 206 to the atmosphere relieving the pressure of the air in chamber 204. Air flowing through whistle opening 208 in a direction indicated by arrow 226 causes reed 209 to vibrate, as shown by double-headed arrow 227 in FIG. 24. The vibrating reed 209 alternately engages U-shaped base 210 producing an audible sound indicating that there is a strain on the air in chamber 204 or over inflation of the air mattress. Valve and audio device 200 automatically prevents and signals over-inflation and over-stressing of the air mattress, which leads to the separation of the seams and the bursting of the walls thereof.

Figure 25:
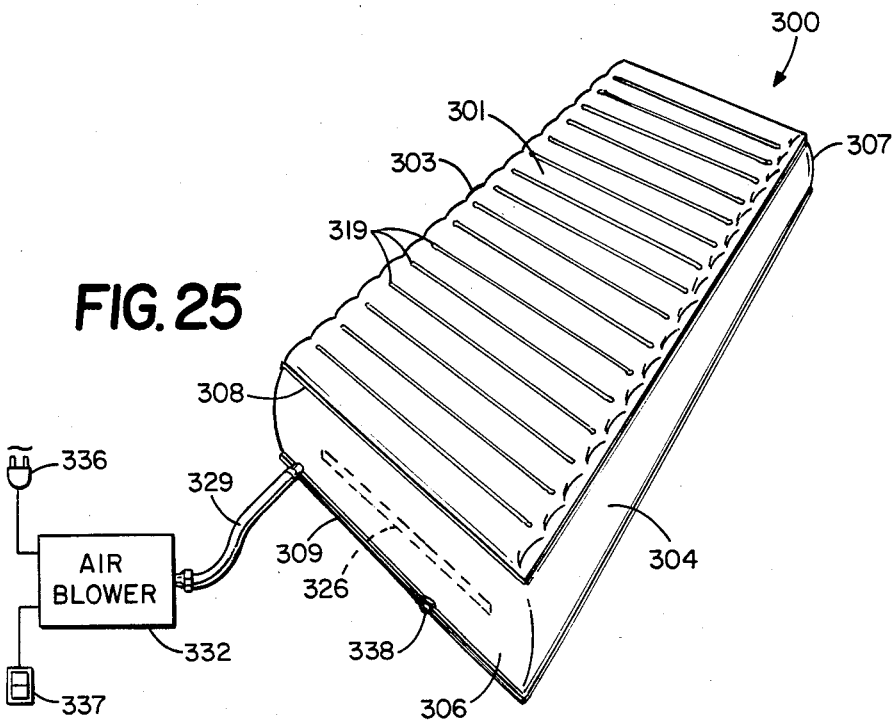
FIG. 25 is a perspective view of a modification of the air mattress having a combined air pressure relief valve and audio device of the invention connected to an air blower.

Referring to FIG. 25, there is shown another modification of the air mattress with a combined air pressure relief valve and audio device of the invention indicated generally at 300. Air mattress 300 accommodates a compressible fluid, such as air, to yieldably support one or more persons in a horizontal or prone position. Preferably, apparatus 300 is an air mattress, used in an air bed to yieldably support one or more prone persons. Apparatus 300 has a combined air pressure relief valve and audio device 338 operable to limit the internal air pressure to about 1 psi to prevent mattress blow-out.

Air mattress 300 has a generally rectangular top wall 301 located over an identical bottom wall 302. Side walls 303 and 304 and end walls 306 and 307 extend between the top and bottom walls 301 and 302 to complete the outer structure of the air mattress. The top wall 301 and side walls 303, 304 and end walls 306, 307 have a continuous upper peripheral edge 308 that are joined together to form a gas impervious seal. In a similar manner, the bottom wall 302 is joined to the side walls 303, 304 and end walls 306, 307 with a lower outwardly directed peripheral edge 309. The walls 301, 302, 303, 304, 306, and 307 are fabric and plastic sheets comprising an inner plastic layer 313 and an outer fabric layer 314. Layers 313 and 314 are integrally joined together to form air impervious walls. Plastic layer 313 may be a Nylon vinyl, polyester Vinyl or Rayon vinyl. These materials are strong, flexible, air impervious, water resistant, and do not deteriorate over time. Fabric layer 314 is a soft fabric, such as cotton or a synthetic fabric, bonded to the outside surface of layer 313.

As shown in FIGS. 25, 26 and 27, a combined air pressure relief valve and audio device, indicated generally at 338, is incorporated in the lower peripheral edge 309. The entire valve and audio device 338 is located within the confinement of edge 309. The operation of the valve and audio device 338 is not affected by outside structures, such as mattress covers, bed frames, and the like. Valve and audio device 338 operates under all positions of the mattress to maintain a predetermined maximum air pressure in the air mattress 300. Preferably, the maximum of air pressure is about 1 psi. An air pressure exceeding 1 psi will open the pressure relief valve and audio device allowing air to exhaust to the atmosphere thereby relieving the pressure of the air in the air mattress. Air flowing out of the air mattress 300 through valve and audio device 338 produces an audible signal. Air mattress 300 can be used with pressures below 1 psi.

An air blower 332 is used to supply the air under pressure to mattress 300 through a hose 329. The air blower has an electric motor (not shown) coupled to a source of electric power with a plug 336. A hand control 337 having a manually operable switch is used to control the air blower to increase the pressure of the air in the mattress or cause the air in the mattress to be evacuated to the atmosphere.

Pressure relief valve and audio device 338 has a cylindrical plastic tubular body 339 having a cylindrical outer surface 341. The outer surface 341 is secured by vulcanization to plastic layers 313 of the bottom wall 302 and end wall 306 forming the lower peripheral edge 309. Body 339 is permanently secured to plastic layers 313. Body 339 has a linear passage 342 accommodating a plug 343. Plug 343 fits into the middle of passage 342 with a friction fit and holds an annular seal 344 in engagement with the inside of body 339. Plug 343 has a central hole 346 accommodating a linear rod 347. Rod 347 has as its outer end a cylindrical head 348 having an outer peripheral groove 349. An O-ring 351 fits into groove 349 and engages an annular inclined seat 352 surrounding the outer end of hole 346. Seat 352 is in an outer annular portion of plug 343. Rod 347 extends through hole 346 toward mattess chamber 324. A guide member 353 is snapped onto the inner end of rod 347. Member 353 has a plurality of circumferentially spaced ears 356 which allow air to flow past cup ember 353 through passage 342. A coil spring 354 is interposed between ears 356 and seal 344 to continuously bias the O-ring 351 into sealing engagement with annular seat 352.

Linear passage 342 also accommodates a whistle 357. Whistle 357 fits into the outer end of passage 342. The whistle 357 has a central tubular portion 358 with an opening 361 accommodating a flat flexible reed 359 and an U-shaped vibrator base 360. Whistle 357 has an inner flange 362 that engages the inside surface of body 339 in a tight fit relation. Triangular supports 363 are secured to flange 362 and tube 358 to hold flange 362 in its close fit relation with body 339. A circular head 364 attached to the outer end of tube 358 has a diameter greater than the diameter of body 339 to prevent the inward movement of whistle 357 in passage 342. An adhesive can be used to secure one or both flanges 362 and 364 to body 339.

When the pressure of the air in the mattress chamber 324 exceeds the biasing force of spring 354, head 348 will move outwardly thereby moving O-ring 351 away from seat 352 opening passage 346. The air flows past head 348 and through the opening 361 of whistle 357 to the atmosphere relieving the pressure of the air in chamber 324. Air flowing through opening 361 causes reed 359 to vibrate. The vibrating reed 359 alternately engages U-shaped base 360 to produce an audible sound indicating that there is a strain on the air chamber. Valve and audio device 338 automatically prevents and signals over-inflation and over-stressing of the air mattress, which leads to the separation of the seams and the flow-out or bursting of the walls 302, 303, 304, 306, and 307. Head 348 and whistle 357 are always located within passage 342 of body 339 so that outside structures, such as mattress covers, bed frames, and the like do not interfere with the operation of the valve. The pressure relief and sound characteristics of valve and audio device 338 is determined by selecting the biasing force of spring 354 to provide a desired maximum pressure of the air in chamber 324. For example, when the biasing force of spring 354 is equal to 1 psi, the valve and audio device 338 will open and produce an audible signal when the pressure of the air in chamber 324 exceeds 1 psi.

While there has been shown and described the preferred embodiments of the air mattress with combined air pressure relief valves and audio devices, it is understood that changes in materials, size, shape, and arrangement of structure may be made by those skilled in the art without departing from the invention. The invention is defined in the following claims.

The embodiments of the invention in which an exclusive property or privilege is claimed are defined as follows:

1. An air mattress accommodating air under pressure for providing a body support comprising: a top wall, a bottom wall spaced from and located below the top wall, side walls and end walls secured to said top and bottom walls, all of said walls comprising flexible air impervious sheet members sealed together along the edge portions thereof to form a chamber for accommodating air under pressure, seam means securing adjacent portions of the sheet means together, a plurality of support means located in said chamber extended between said side walls and secured to said top and bottom walls providing transverse passages accommodating air and limiting outward expansion of the top and bottom walls when air under pressure is stored in said chamber, each of said side walls secured to end portions of said support means to limit outward expansion of the side walls when air pressure is stored in said chamber, each of said end portions having at least one opening allowing air communication between said transverse passages, tube means mounted on one of said walls to facilitate supplying air under pressure into said chamber, and audible air pressure relief valve means mounted in the seam means open to said chamber and the atmosphere, said valve means operable to vent air from said chamber when the pressure of air in said chamber exceeds a selected maximum limit, said valve means having an audio device to signal when air is vented from said chamber, said audible pressure relief valve means having a cylindrical tube, said tube having an outer end and a passage open to said chamber and atmosphere, said audio device mounted on the outer end of said tube and projected into the outer end of said passage, said audio device having a generally flat head that engages the outer end of said tube to retain the audio device with the passage, a valving member located within the tube inwardly of the audio device, said valving member being selectively movable between open and closed positions, and spring means within the tube to bias the valving member to a closed position, said spring means having a biasing force that allows the valving member to move to an open position when the pressure of the air within the chamber exceeds the selected maximum limit thereby venting air from the chamber through the passage and the audio device which creates an audible sound.

2. The air mattress of claim 1 wherein: all of the walls and support means are combined fabric and plastic sheet members, said valve means having a body secured to said plastic sheet members in the seam means.

3. The air mattress of claim 1 including: end webs located in said chamber secured to said end walls and a support means to limit outward expansion of the end walls.

4. The air mattress of claim 3 wherein: said end webs are sheet members located between said top and bottom walls and extended generally parallel thereto.

5. The air mattress of claim 1 wherein: said cylindrical tube is secured to and located within the seam means.

6. The air mattress of claim 1 wherein: said audio device has a tubular portion having a passage open to atmosphere, said tubular portion being located within the tube, and reed means located within the passage of the tubular portion adapted to vibrate and create an audible sound when air flows through said passage of the tubular portion to atmosphere.

7. The air mattress of claim 1 wherein: said support means have a plurality of holes allowing said top and bottom walls to expand outwardly to form a plurality of outward convex curved portions therein.

8. The air mattress of claim 7 wherein: adjacent support means have transverse offset holes.

9. Air air mattress accommodating air under pressure for providing a body support comprising: a first wall, a second wall spaced from the first wall, side walls, and end walls secured to said first and second walls to form a chamber for accommodating air under pressure, all of said walls comprising flexible air impervious sheet members, edge means securing said walls together to enclose said chamber, a plurality of support means located in said chamber extended between said side walls and secured to said first and second walls and side walls providing transverse passages accommodating air and limiting outward expansion of the first and second walls and side walls when air under pressure is stored in said chamber, tube means mounted on one of said walls to facilitate supplying air under pressure into said chamber, audible pressure relief valve means operable to limit the air pressure in said chamber by venting air from said chamber when the pressure of air in said chamber exceeds a selected maximum pressure, said valve means having an audio device to signal when air is vented from said chamber through said valve means, said valve means comprising a cylindrical tube having an outer end and a passage open to the chamber and atmosphere, said audio device being mounted on the outer end of tube and projected into said passage operable to produce an audio signal when air is vented to said valve means, said audio device having a generally flat head that engages the outer end of said cylindrical tube to retain the audio device within the passage, a valving member located within the passage inwardly of said audio device selectively movable between open and closed positions to allow air to flow through said passage or block the flow of air through said passage, and spring means within said passage to bias the valving member to its closed position, and means mounting said audible pressure relief valve means on said mattress.

10. The air mattress of claim 9 wherein: all of said walls and support means are combined fabric and plastic sheet members, said edge means securing the walls together comprising seam means, said seam means mounting said valve means on the mattress.

11. The air mattress of claim 9 wherein: the edge means comprise seam means joining the top and bottom walls to the side and end walls, said cylindrical tube being located within and secured to the seam means.

12. The mattress of claim 9 wherein: said audio device has a tubular portion having a passage open to atmosphere, said tubular portion being located within the tube, and reed means located within the passage of the tubular portion adapted to vibrate and create an audible sound when air flows through said passage of the tubular portion to atmosphere.

13. The air mattress of claim 9 wherein: the spring means has a biasing force that allows the valving member to move to its open position when the pressure of the air within the chamber exceeds the selected maximum pressure thereby venting air from the chamber through the passage and the audio device creating an audible sound.

14. The air mattress of claim 9 wherein: the means mounting said audible pressure relief valve means on the mattress comprises a flexible boot secured to one wall of the mattress and projected into the chamber.

15. The air mattress of claim 14 wherein: said boot has an annular wall surrounding said valve means to hold the valve means on said boot.

16. An air mattress accommodating air under pressure for providing a body support comprising: wall means of flexible air impervious members forming a chamber to accommodate air under pressure, means mounted on said wall means useable to supply air to said chamber, and audible air pressure relief valve means operable to limit the air pressure in said chamber by venting air from said chamber when the pressure of air in said chamber exceeds a selected maximum pressure, said valve means having a tube having an outer end and a passage open to the chamber and atmosphere, an audio means projected into the outer end of the tube for producing a signal when air is vented from said chamber, said audio device comprising a plug member having a generally flat head that engages the outer end of said tube to retain the plug member within the passage, a one way valve located within said passage of the tube inwardly of the audio means, said valve being selectively movable between open and closed positions to allow air to flow through said passage or block the flow of air through said passage, and biasing means within said passage to bias the valve to its closed position, and means mounting the valve means on said wall means.

17. The air mattress of claim 16 wherein: said means mounting the valve means on said wall means comprises a flexible boot attached to said wall means and projected into said chamber.

18. The air mattress of claim 17 wherein: said boot has an annular wall surrounding said valve means to hold the valve means on said boot.

19. The air mattress of claim 16 wherein: the biasing means has a biasing force that allows the valving member to move to its open position where the pressure of the air within the chamber exceeds the selected maximum pressure thereby venting air from the chamber through the passage and the audio device to create an audible sound.

20. The air mattress of claim 16 wherein: said audio device has a tubular portion having a passage open to atmosphere, said tubular portion being located within the tube, and reed means located within the passage of the tubular portion adapted to vibrate and create an audible sound when air flows through said passage of the tubular portion to atmosphere.

21. The air mattress of claim 16 wherein: said wall means includes a seam, said tube being located within said seam.

22. The air mattress of claim 16 including: a flexible boot attached to said wall means and projected into said chamber, said tube being mounted on said boot.

23. An audio fluid pressure relief valve comprising: a cylindrical tube having a passage, one-way valving member located within said passage movable between open and closed positions to control the flow of fluid through said passage, biasing means engageable with the tube and valving member to bias the valving member to its closed position, an audio means mounted on said tube operable to produce an audio signal when said valving member is in an open position and fluid is flowing through said passage in the tube, said tube having an inner end, an outer end, and an annular flange projected into the passage between said ends, said flange having an annular seat for the valving member, said biasing means operable to bias the valving member into engagement with said seat to close the passage, said audio means comprising a plug member extended into the passage from the outer end thereof, said plug member having a generally flat head engaging the outer end of the tube to retain the plug member wholly within the passage, said plug member having a passage open externally to the valve and the passage of the tube, and vibrating reed means located in said passage of the plug member operable to generate an audible sound when fluid flows through said passages.

* * * * *